US006266501B1

(12) United States Patent
Mizuishi et al.

(10) Patent No.: US 6,266,501 B1
(45) Date of Patent: Jul. 24, 2001

(54) IMAGE-FORMING APPARATUS HAVING A SEAL FOR A DEVELOPER AND A METHOD FOR DETECTING A REMOVAL OF THE SEAL

(75) Inventors: Haruji Mizuishi, Tokyo; Masaru Tanaka; Kenzo Tatsumi, both of Yokohama; Ken Amemiya, Tokyo; Toshitaka Yamaguchi, Ohmiya; Hideki Zemba, Yokohama; Noriyuki Usui; Mayumi Ohori, both of Kawasaki; Hiroshi Mizusawa, Tokyo, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/482,961

(22) Filed: Jan. 14, 2000

(30) Foreign Application Priority Data

Jan. 14, 1999 (JP) ..... 11-007900

(51) Int. Cl.[7] ..... G03G 15/08
(52) U.S. Cl. ..... 399/106; 399/27; 399/103
(58) Field of Search ..... 399/13, 24, 25, 399/27, 49, 53, 66, 100, 101, 102, 103, 106, 119, 60

(56) References Cited

U.S. PATENT DOCUMENTS

| | | | | |
|---|---|---|---|---|
| 4,873,549 | * | 10/1989 | Tada et al. | 399/25 |
| 5,077,584 | | 12/1991 | Tanaka et al. . | |
| 5,109,254 | | 4/1992 | Oka et al. . | |
| 5,122,837 | * | 6/1992 | Sonoda et al. | 399/106 X |
| 5,194,897 | * | 3/1993 | Yoshiyama et al. | 399/100 |
| 5,198,861 | * | 3/1993 | Hasegawa et al. | 399/27 |
| 5,557,382 | | 9/1996 | Tatsumi et al. . | |
| 5,729,788 | * | 3/1998 | Hirohashi et al. | 399/66 |
| 5,734,953 | | 3/1998 | Tatsumi . | |
| 5,745,822 | * | 4/1998 | Nishimura et al. | 399/106 |
| 5,765,079 | | 6/1998 | Yoshiki et al. . | |
| 5,828,927 | * | 10/1998 | Yoo et al. | 399/101 |
| 5,828,935 | | 10/1998 | Tatsumi et al. . | |
| 5,864,733 | | 1/1999 | Mae et al. . | |
| 5,887,224 | | 3/1999 | Mizuishi et al. . | |
| 5,915,143 | | 6/1999 | Watanabe et al. . | |
| 6,026,253 | * | 2/2000 | Domon et al. | 399/27 X |
| 6,122,458 | * | 9/2000 | Kita et al. | 399/27 |

FOREIGN PATENT DOCUMENTS

| | | |
|---|---|---|
| 3-138672 | 6/1991 | (JP) . |
| 5-066669 | 3/1993 | (JP) . |
| 5-257352 | 10/1993 | (JP) . |
| 7-015609 | 1/1995 | (JP) . |

* cited by examiner

*Primary Examiner*—Sandra Brase
(74) *Attorney, Agent, or Firm*—Oblon, Spivak, McClelland, Maier & Neustadt P.C.

(57) ABSTRACT

An image-forming apparatus includes an image-bearing device that holds an electrostatic latent image and a toner image thereon, and a developer container that contains and agitates a developer having at least a toner. The image-forming apparatus also includes a developer-bearing device that carries the developer to develop the electrostatic latent image on the image-bearing device, and a density sensor that detects an optical density of a surface of the image-bearing device and a toner image on the image-bearing device. Further, the image-forming apparatus includes a developer seal that seals the developer in the developer container, wherein the seal is disposed between the developer container and the developer-bearing device, and an actuator configured to actuate the developer container and the developer-bearing device. The image-forming apparatus still further includes a control device that determines whether the developer seal is removed according to information on the optical density of the toner image output by the density sensor.

44 Claims, 5 Drawing Sheets

IMAGE-FORMING APPARATUS HAVING A SEAL FOR A DEVELOPER AND A METHOD FOR DETECTING A REMOVAL OF THE SEAL

BACKGROUND OF THE INVENTION

1. Field of the Invention

The present invention relates to an image-forming apparatus having a seal for containing a developer in a developing device and method for detecting a removal of the seal. More particularly, the present invention relates to an image-forming apparatus having a replaceable compact developing device with a seal for the developer contained therein and a method for detecting the removal of the seal.

2. Discussion of the Background

In recent years, demand for easily maintainable image-forming apparatuses, such as laser printers, photocopiers or a facsimile machine has increased so the user of such an apparatus can maintain and use the apparatus in a stable condition by themselves instead of calling a service person. For example, it is desired by users of image-forming apparatuses to easily replace by himself or herself used developer, at the end of its life or after being damaged. In addition, as appreciated by the present inventors, that it is desired that a replacing unit or module is compact in size so as to be easily handled during replacing operations.

Japanese Laid-Open Patent Publication No. 03138672 describes an image-forming device that has a photoconductive drum as an image bearer, a developing device providing a magnetic brush roller as a developer beam, and a developer container filled with a developer mix sealed with a seal member. The developing device including the developer container can be relatively easily replaced with new one that is filled with new developer mix by the user of the image-forming device, when the replacement is required. After the new developing device is installed, the seal member is manually removed so that the developer mix in the container moves toward the developer bearer for being used in an image forming operation. However, as recognized by the present inventors, the image forming device does not detect the removal of the seal member and so the user may erroneously skip the manual operation of removing the seal member, and start an image-forming operation. In this scenario, when the seal member is not removed, no developer mix is supplied to the developer bearer, and no developer mix is applied to the image bearer. Consequently, the image-forming device does not form a toner image on the image bearer.

Further, as recognized by the present inventors, when no toner is applied to the image bearer, a doctor blade in a cleaning device for cleaning the image bearer may turn over or chip relatively easily because of the relatively large friction between the doctor blade and the image bearer due to lack of toner as a lubricant, The turning over or chipping may damage not only the doctor blade but also the image bearer, such as by creating scratches on the surface of the image bearer.

SUMMARY OF THE INVENTION

The present invention has been made in view of the above-discussed and other problems, and has as one objective to overcome the above-discussed and other problems associated with the conventional apparatuses and methods. Accordingly, one feature of the present invention is a novel image-forming apparatus having a replaceable compact developing device with a seal for a developer and a method for detecting a removal of the seal.

Another feature of the present invention is to provide a novel image-forming apparatus having a replaceable compact developing device with a seal for a developer and a method for detecting a removal of the seal that can prevent a doctor blade from cleaning an image bearer, resulting in the image bearer becoming damaged.

The image-reading apparatus of the present invention includes an image-bearing device that holds an electrostatic latent image and a toner image thereon, and a developer container that contains and agitates a developer, having at least a toner. The image-forming apparatus also includes a developer-bearing device that bears the developer so as to develop the electrostatic latent image on the image-bearing device, and a density sensor that detects an optical density of a surface of the image-bearing device and a toner image on the image-bearing device. Further, the image-forming apparatus includes a developer seal that seals the developer in the developer container, wherein the seal is disposed between the developer container and the developer-bearing device, and an actuator configured to actuate the developer container and the developer-bearing device. The image-forming apparatus also includes a control device that determines whether the developer seal is removed according to information on the optical density of the toner image output by the density sensor.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
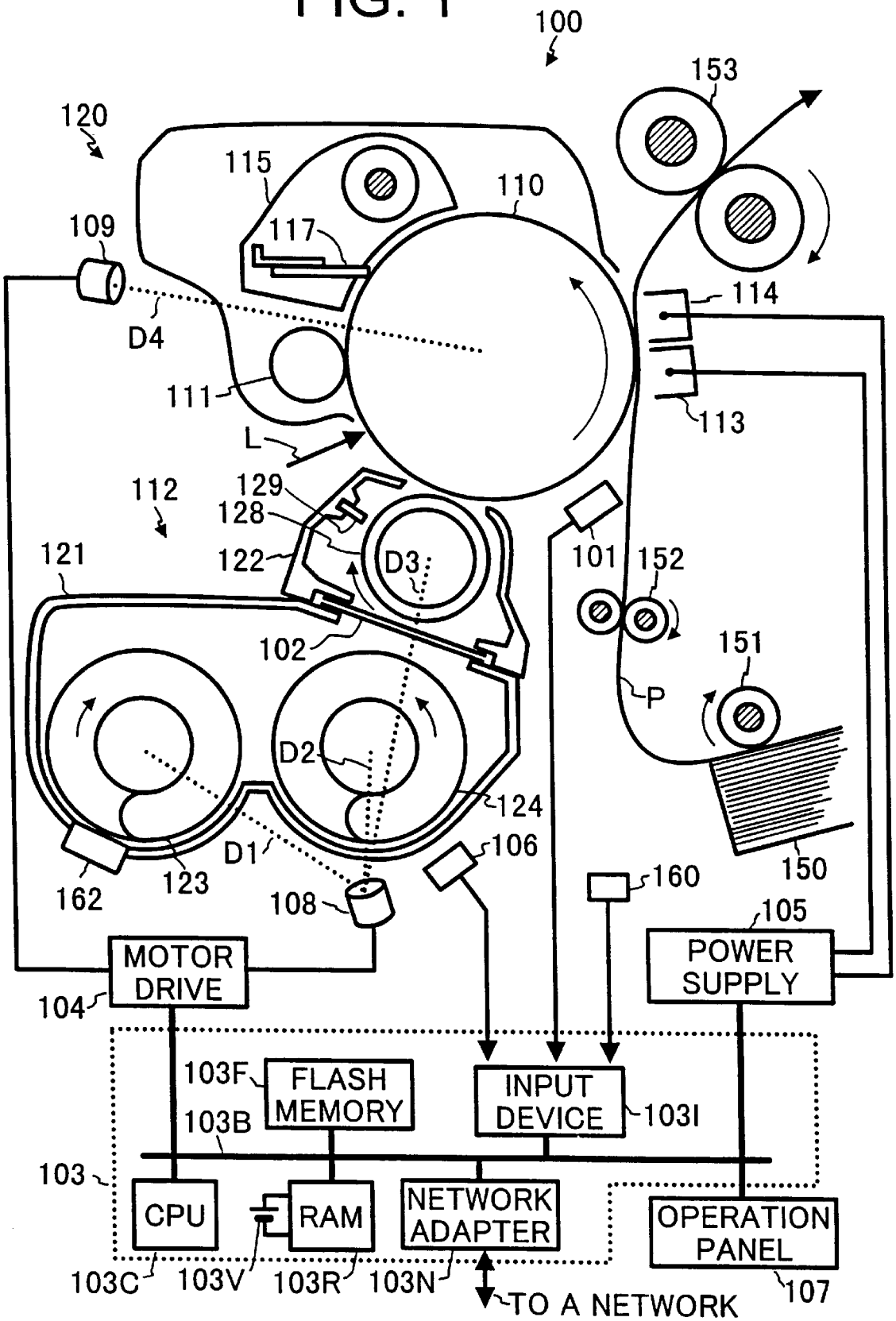
FIG. 1 is a schematic view of a structure of an image-forming apparatus as an exemplary embodiment of the present invention.

Referring now to the drawings, wherein like reference numerals designate identical or corresponding parts throughout the several views, and more particularly to FIG. 1 thereof, a schematic view of an image-forming apparatus 100 according to the present invention is illustrated. The image-forming apparatus 100 is a laser printer although the invention is suitable for use in other developer-based image forming apparatuses. The image-forming apparatus 100 includes a toner density sensor 101, a control module 103, a motor drive 104, a power supply 105, a developing device detector 106, an operation panel 107, a first motor 108, a second motor 109, a developing device 112, an image transfer device 113, a sheet-separating device 114, a photoconductor module 120, a sheet tray 150, a sheet feed roller 151, a register roller pair 152, a fixing roller pair 153, and a door interlock sensor 160 arranged as shown.

The control module 103 includes an address and data bus 103B, a network adaptor 103N (for connection to a LAN and/or Internet), a central processing unit (CPU), 103C, a random accesses memory (RAM) 103R, a flash memory 103F, and an input device 103I, The flash memory 103F stores instruction codes executed by the CPU 103C. The flash memory 103F may be replaced with other types of data storing devices, such as a read-only memory, a hard disk, a CD-ROM, a DVD-ROM, etc. The RAM 103R may have a backup battery 103V. Alternatively, some or all of the processing performed by the CPU 103C and RAM 103P, may be performed in hardware such as on an ASIC, or PAL.

The developing device detector 106 detects whether the developing device 112 is installed in the image-forming apparatus 100, The developing device detector 106 also detects whether the installed developing device 112 is one that has not been used for a developing operation or once used for a developing operation. In other words, the output of developing device detector 106 is classified into three categories, i.e., no-developing device, a new-developing device, and a used-developing device. The door interlock sensor 160 detects whether a door, which encloses the developing device 112 and the photoconductor module 120, is closed.

The photoconductor module 120 can be replaced with a new module as a single unit as necessary. The photoconductor module 120 includes a photoconductive drum 110 as an image-bearing device, an electrical charging device 111, and a drum-cleaning device 115 having a doctor blade 117. The photoconductive drum 110 is rotated by the second motor 109 via a driveline D4.

The developing device 112 can be replaced with a new single unit as necessary, for example, when the developing device 112 becomes damaged. When the developing device 112 has been used for a certain period or a certain number of image forming operations, the used developing device 112 may also be replaced with a new one because the useful life of a developer mix in the developing device 112 is limited. In addition, at a beginning of using the image-forming apparatus 100, a new developing device 112 can also be installed in the image-forming apparatus 100.

The developing device 112 includes a magnetic brush unit 122 having a magnetic brush roller 128 as a developer bearer, and a developer doctor 129, The developing device 112 also includes a developer container 121 having a first agitating auger 123, a second agitating auger 124, and a toner concentration sensor 162, The developing device 112 further includes a seal 102 for sealing a developer mix in the developer container 121.

In one embodiment the developing device includes an independent container that holds a developer sealed with a seal member and an independent agitating device having a toner concentration sensor. When the developing device is installed and the seal member is removed, the developer in the independent container comes into the independent agitating device. Thereby, the toner concentration sensor can detect the removal of the seal member because the toner concentration sensor can detect a change from an empty state in the agitating device to a filled state with developer. Another embodiment provides for a more compact structure, in which if the developer container 121 functions as both of a container and an agitator of the developer mix; therefore, the developing device 112 is compactly constructed in comparison with conventional developing devices. Consequently, an overall size of the image-forming apparatus 100 is reduced.

Figure 2:
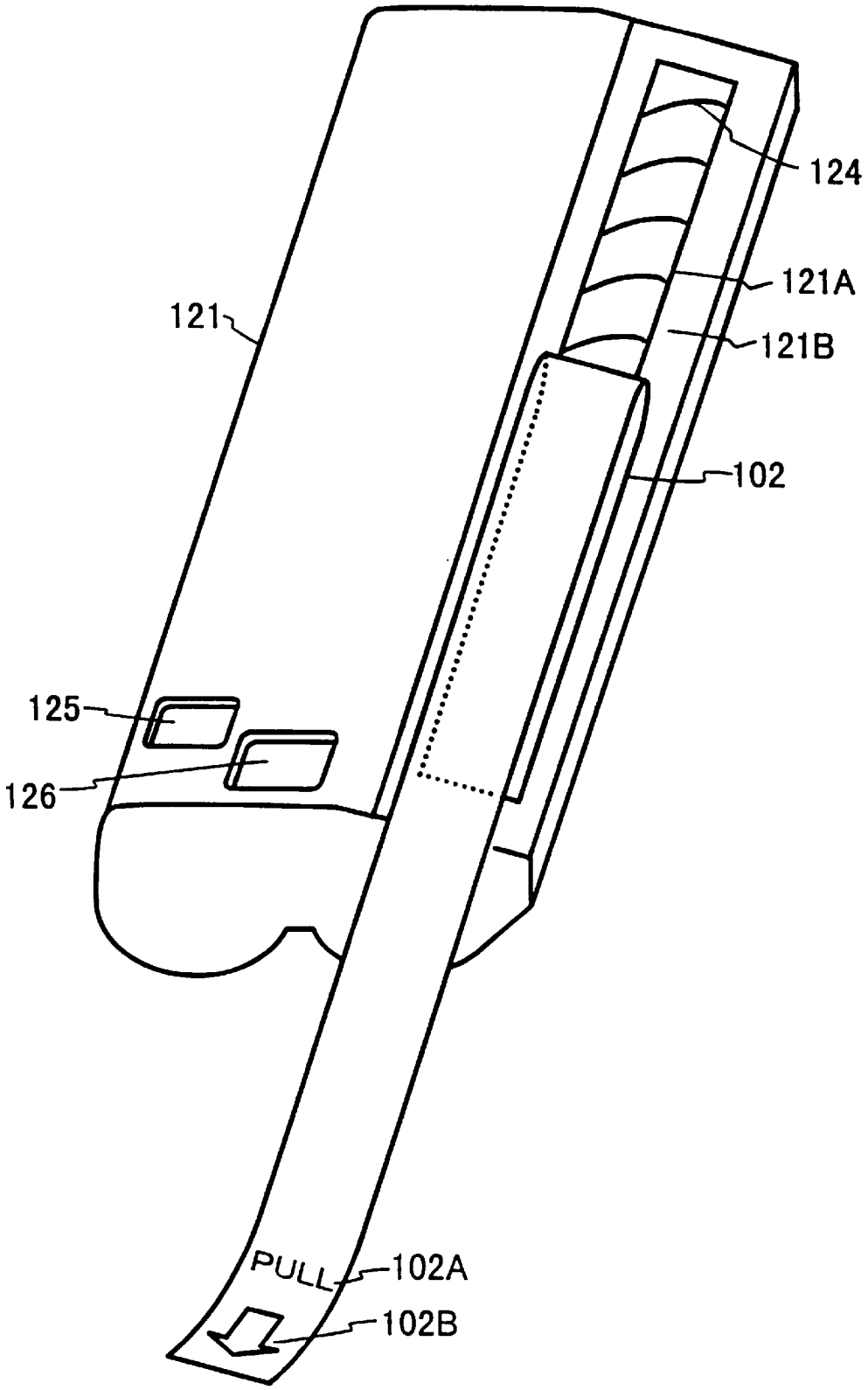
FIG. 2 is a perspective schematic view of an exterior of a developer container and a seal for a developer mix of the image-forming apparatus of FIG. 1.

FIG. 2 is a perspective schematic view illustrating an exterior of the developer container 121 and the seal 102 for sealing a developer mix. The developer container 121 contains the developer mix, which includes a ferrite carrier and a toner, for example. The developer mix can be replaced with other types of developers, for example, a single component developer, such as a dielectric toner or a magnetic toner. The developer container 121 has a first hole 125 for receiving a toner sent from a toner replenishment device and a second hole 126 for receiving a toner sent from the drum-cleaning device 115. The developer container 121 also has an aperture 121A that allows the developer mix to move through the aperture 121A toward the magnetic brush unit 122.

The seal 102 can be a flexible sheet folded in a U shape, half of which can be adhered to a surface 121B of the developer container 121 and a circumference of the aperture 121A until such time as when the developing device 112 is used. Thereby, the developer mix may not spill out of the developer container 121, even when the developer container 121 is transported for a relatively long distance, for example, from a manufacturing plant to an end user of the image-forming apparatus 100. The seal 102 also reduces air circulation between inside and outside the developer container 121, and thereby deterioration of the developer mix in the developer container 121 can be decreased.

When a developing device 112 is installed in the image-forming apparatus 100, the seal 102 is preferably removed. The removal operation of the seal 102 can be done either before or after the installation of the developing device 112 inside the image-forming apparatus 100. The seal 102 may have instructions, such as instructions 102A and 102B as illustrated in FIG. 2, for instructing a manual removal operation of the seat 102.

In FIG. 2, the seal 102 is shown with instructions regarding which way it is to be peeled off from the face 121B of the developer container 121, The seal 102 can be replaced with another type of seal, such as a shutter plate, etc.

Figure 3A:
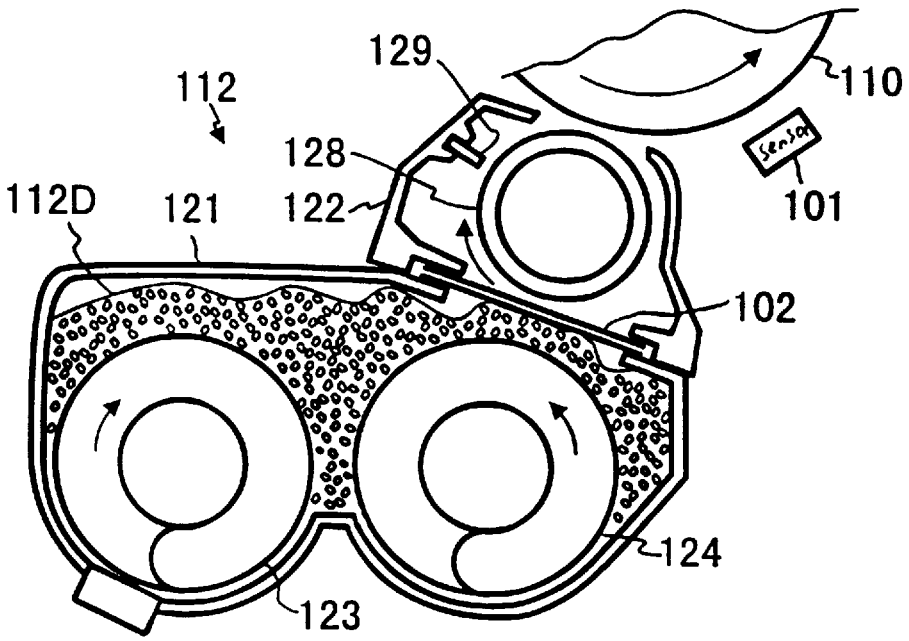
FIG. 3A is a schematic view of the a developing device of the image-forming apparatus of FIG. 1 when the seal for the developer mix is not removed.

FIG. 3A is a schematic view illustrating the developing device 112 in an image-forming operation with a developer mix 112D being sealed by the seal 102. As illustrated in FIG. 3A, the developer 112D stays in the developer container 121, even the first agitating auger 123 and the second agitating auger 124 agitates the developer mix 112D because of the seal 102 remaining in place.

Figure 3B:
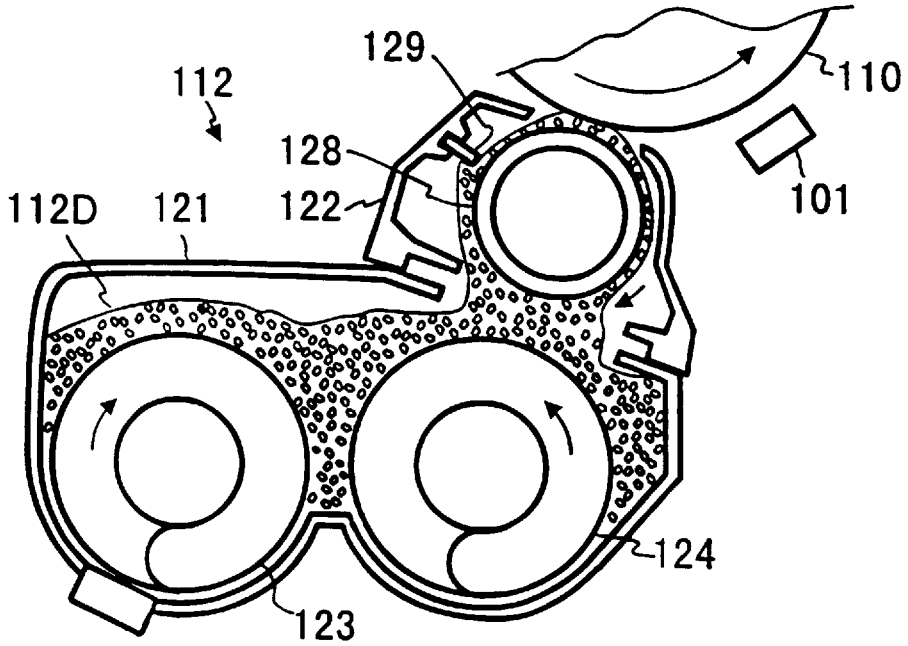
FIG. 3B is a schematic view of the developing device when the seal for the developer mix is removed.

FIG. 3B is a schematic view illustrating the developing device 112 in an image-forming operation having the developer mix 112D when unsealed. When the developer mix 112D is unsealed, i.e., the seal 102 is removed, and the first and second augers 123 and 124 and the magnetic brush roller 128 are rotated, the developer mix 112D goes toward the magnetic brush roller 128. As a result, the magnetic brush roller 129 forms a developer brush around the magnetic brush roller 128. The developer doctor 129 extends to a length such that a tip of the developer doctor 129 extends to a length such that a tip of the developer doctor 129 approaches a surface of the magnetic brush roller 128 so as to uniformly spread the developer thereon in an amount suitable for developing an electrostatic latent image on the photoconductive drum 110. After the developer mix 112D is applied so as to develop the electrostatic latent image, the developer mix 112D returns to the developer container 121.

The toner density sensor 101 is, for example, a light-emitting device and a light-receiving device. As the light-emitting device, a light emitting diode (LED) or a light bulb may be used, for example. As the light receiving-device, a photodiode or a phototransistor may be used, for example. The light-emitting device irradiates the photoconductive drum 110. The light receiving-device receives light refracted on the photoconductive drum 110. Therefore, the intensity of the reflected light is affected by a reflection coefficient of a surface of the photoconductive drum 110, i.e., a condition of the surface of the photoconductive drum 110. For example, when a toner image covers the surface of the photoconductive drum 110, intensity of the reflected light is smaller than that from directly reflected by the surface of the photoconductive drum 110. Likewise, intensity of the reflected light varies according to an optical density of the toner image on the photoconductive drum 110.

Thus, the toner density sensor 101 outputs a value depending on the condition of the surface of the photoconductive drum 110. As an example, the toner density sensor 101 outputs about 4 volts when there is no toner on the surface of the photoconductive drum 110, about 3 volts for a thin toner image, about 2 volts for a preferable density toner image, and 1 volt for a thick toner image.

The toner density sensor 101 is used for controlling an optical density of a toner image. In general, a lower toner concentration of the developer mix forms a lower optical density toner image, and a higher toner concentration forms a higher optical density toner image. Therefore, when the toner density sensor 101 detects such that the optical density of toner image is low, the control module 103 can supply a toner into the developer mix to increase the toner concentration of the developer mix through the first hole 125 illustrated in FIG. 2.

The optical density of a toner image formed on the photoconductive drum 110 is also affected by an electrical charge of the toner in the developer mix 11 2D, even when the toner concentration of the developer mix 112D is not changed. For example, when a developing device 112 is installed in the image-forming apparatus 100 and the developer mix 112D has not been sufficiently agitated yet a toner image may be formed thinner than a normal or a preferable density. Accordingly, the toner density sensor 101 outputs a particular ambiguous voltage, such as 2.5 volt to 3.5 volts, for example. When, toner image is too thin due to insufficient agitation of the developer mix 112D, further agitation is preferable rather than adding toner into the developer mix 112D to avoid the developer mix 112D from having an excessively high toner concentration. An excessively high toner concentration of the developer mix 112D often sods an image background and scatters toner particles inside the image-forming apparatus 100.

Even though the toner concentration of the developer mix is substantially constant, the optical density of the toner image may vary by other factors as well, for example, environmental conditions, such as a temperature or humidity of the atmosphere in the image-forming apparatus 100. The toner concentration sensor 162 detects a ratio of a volume of the toner to the whole volume of the developer mix. Therefore, an image density control operation or a toner supplying operation may also be performed based on readings from both the output of the toner density sensor 101 and the output of the toner concentration sensor 162.

The toner density sensor 101 is also used for detecting whether the seal 102 is removed from the developing device 112. When the seal 102 is removed, a toner image can be formed, and the toner density sensor 101 outputs a value, such as 2 volts or 3 volts. However, if the seal 102 has not been removed, a toner image cannot be formed, and consequently the toner density sensor 101 outputs a value, with as about 4 volts, which is obtained from reflected light from an area where a toner image would have been formed on the surface of the photoconductive drum 110. That is, the control module 103 can determine whether the seal 102 is removed or not removed based on information from the toner density sensor 101.

The control module 103 determines the removal of the seal 102 by comparing the output of the toner density sensor 101 with a threshold value, such as 3.5 volts. Thus, when the seal 102 is not removed, the output of the toner density sensor 101 exceeds the threshold value, and when the seal 102 is removed, the output of the toner density sensor 101 falls short of the threshold value.

An output of the toner density sensor 101 obtained from the surface of the photoconductive drum 110 is referred to as "Vsg" and an output obtained from the area where a toner image would have been formed on the surface of the photoconductive drum 110 is referred to as "Vsp". When the seal 102 is removed a difference "Vsg-Vsp" becomes about 1 to 2 volts, and when the seal 102 is not removed, the difference "Vsg-Vsp" becomes close to zero volt, for example. Therefore, the control module 103 can also determine the removal of the seal 102 by comparing the difference Vsg-Vsp and a second threshold value, such as 0.5 volts. That is, when the seal 102 is removed, the difference Vsg-Vsp exceeds the second threshold value, and when the seal 102 is not removed, the difference Vsg-Vsp falls short of the second threshold value.

Referring back to FIG. 1, a normal image forming operation is performed as follows. The control module 103 receives a print command accompanying print data from an external apparatus, such as a personal computer, via a network (such as a LAN or the Internet) and the network adaptor 103N. Then, the control module 103 activates the motor drive 104 to rotate the first motor 108 and the second motor 109.

The second motor 109 rotates the photoconductive drum 110 counterclockwise. The electrical charging device 111 charges the surface of the photoconductive drum 110 at a substantially uniform voltage. The charged photoconductive drum 110 is then exposed by a raster scanning laser beam denoted as "L" in FIG. 1, according to the received print data. Thus, an electrostatic latent image according to the received print data is formed on the photoconductive drum 110.

Meanwhile, the first motor 108 rotates the first agitating auger 123 clockwise, the second agitating auger 124 counterclockwise, and the magnetic brush roller 128 clockwise. The rotation of the first and second augers 123 and 124 cause circulation of the developer mix in the developer container 121, and thereby toner particles in the developer mix are electrically charged by an effect of frictional electrification. The agitated developer mix is urged onto a magnetic brush around the magnetic brush roller 128. The magnetic brush roller 128 is biased at an appropriate voltage to the voltage of the electrostatic latent image on the photoconductive drum 110. The magnetic brush, with the developer mix, contacts the electrostatic latent image on the photoconductive drum 110, and thereby the toner particles in the developer mix adhere to the electrostatic latent image, Thus, the electrostatic latent image is developed, i.e., a toner image according to the print data is formed on the photoconductive drum 110, The toner image is then conveyed to a position opposing the toner density sensor 101 where the toner density sensor 101 can detect an optical density of the toner image. When the toner image on the photoconductive drum 110 arrives at a position where the image transfer device 113, a sheet of paper P is conveyed by the sheet feed roller 151 and the register roller pair 152 from the sheet tray 150. While the sheet P is conveyed at a substantially same speed as the circumferential speed of the photoconductive drum 110, the power supply 105 supplies the image transfer device 113 with an appropriate voltage with the polarity of the voltage being counter to a polarity of the electrically charged toner particles. Thereby, the toner image on the photoconductive drum 11 0 is attracted toward the sheet P and transferred to the sheet P.

The power supply 105 also supplies the sheet-separating device 114 with an appropriate voltage, such as a DC biased AC voltage. Thereby, the sheet-separating device 114 separates the sheet P from the photoconductive drum 110. The sheet P having the transferred toner image is further conveyed to the fixing roller pair 153 where the toner image is fixed on the sheet P, and then the sheet P is discharged outside the image-forming apparatus 100 as a printed sheet.

The toner particles that remain on the photoconductive drum 110, i.e., toner particles that have not been transferred to the sheet P, are removed by the doctor blade 117 of the drum-cleaning device 115. These toner particles that remain on the photoconductive drum 110 function as a lubricant between the photoconductive drum 110 and the doctor blade 117 so that the photoconductive drum 110 and the doctor blade 117 may be less damaged as compared to when no toner is supplied. The removed toner is conveyed for reuse into the developer container 125 through the second hole 126 illustrated in FIG. 2. Further, for discharging the photoconductive drum 110, a discharging lamp, which irradiates the photoconductive drum 110, may be used.

Figure 4:
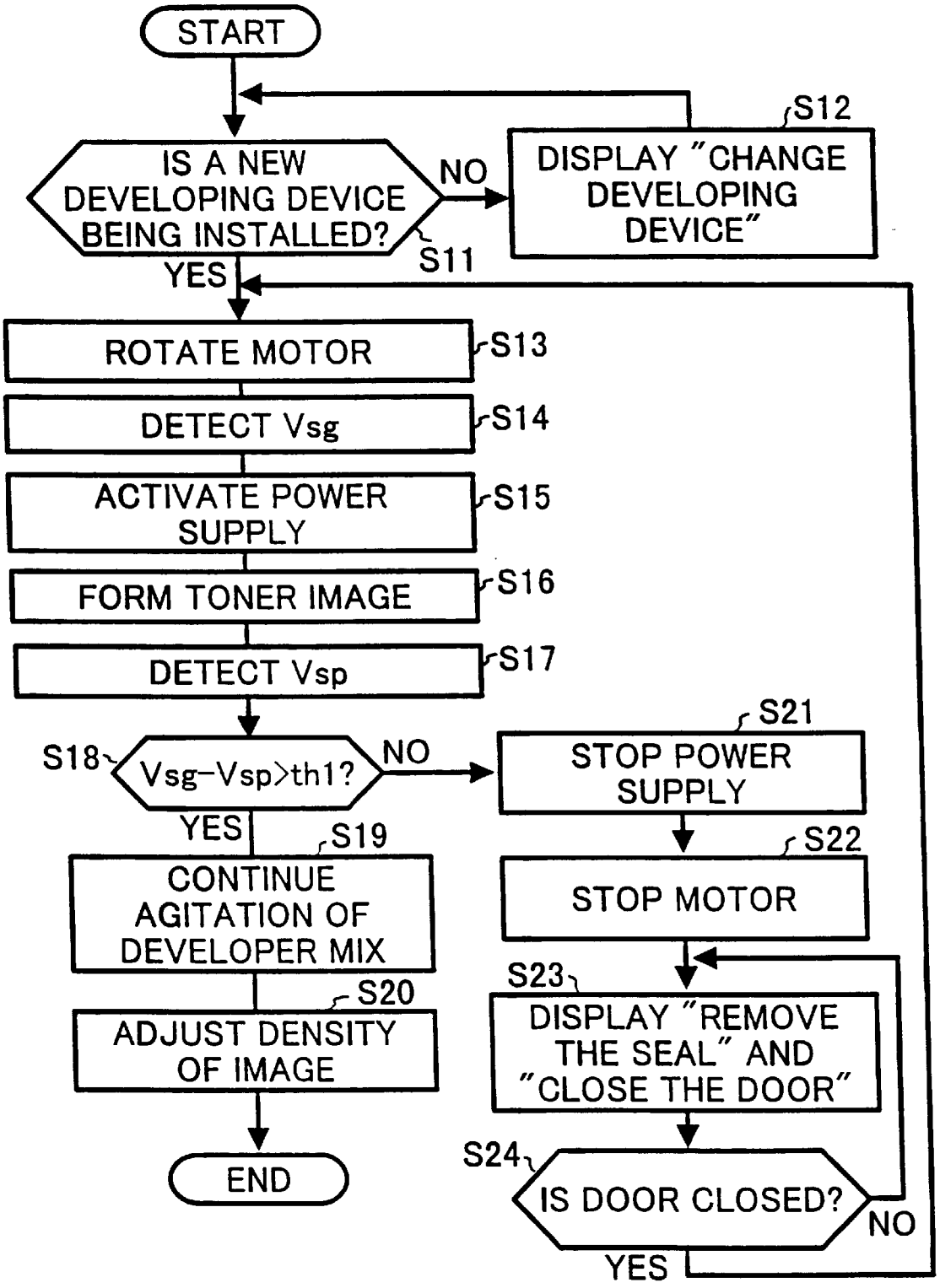
FIG. 4 is a flowchart of operational steps for detecting removal of the seal in the image-forming apparatus of FIG. 1.

FIG. 4 is a flowchart illustrating operational steps for practicing a detecting operation regarding the removal of the seal 102. Instructions of a program that performs the operational steps are stored in the flash memory 103F, and the program is invoked when a developing device 112 is not installed or is preferably replaced with a new one, For example, after the developing device 112 has been used for printing of a predetermined number of images, the program is invoked.

With reference to FIG. 4, in a step S11 , the control module 103 receives information on a developing device 112 from the developing device detector 106 via the input device 103I, and then determines whether a new developing device 112 is being installed in the image-forming apparatus 100. Whet a new developing device 112 is being installed, the procedure proceeds to a step S13. When a new developing device 112 is not installed, the procedure branches to a step S12. In the step S12, the control module 103 sends a command to the operation panel 107 to display a message "CHANGE DEVELOPING DEVICE" and the operation panel 107 displays the message. Then, the procedure returns to the step S11. Accordingly to the message, the user of the image-forming apparatus 100 may install a new developing device 112.

In the step S13, the control module 103 sends a command to the motor drive 104 to rotate the first motor 108 and the second motor 109, and the motor drive 104 rotates the motors 108 and 109. In a step S14, the control module 103 receives an output voltage from the toner density sensor 101 that is obtained by reflection of light reflected by the surface of the photoconductive drum 110. The output voltage regarding the reflected light from the surface of the photoconductive drum 110 is referred as "Vsg". In addition, an adjustment of intensity of the light-emitting device of the toner density sensor 101 may be performed before the above-described detecting operation of Vsg for calibrating the toner density sensor 101. For example, an adjustment is performed such that the output voltage Vsg becomes around 4 volts.

In a step S15, the control module 103 activates the power supply 105 to output power. According to the activation, the power supply 105 starts supplying a charging power to the photoconductive drum 110 through the electrical charging device 111. The power supply 105 also supplies a bias voltage to the developing device 112. Further, the power supply 105 supplies a counter-transfer voltage, which is the same polarity to the electrically charged toner, to the image transfer device 113. The polarity of the counter-transfer voltage is opposite to a transferring voltage in a normal image forming operation. The counter-transfer voltage provided to the image transfer device 113 decreases the probably of the image transfer device 113 from becoming soiled. The counter-transfer voltage also decreases a sheet of paper to be printed from becoming soiled in a normal image forming operation because the sheet passes-through the less soiled image transfer device 113.

In addition, the image transfer device 113 may be further cleaned by an automatic cleaner after the current detecting operation of the removal of the seal 102 is completed, Thereby, the sheet of paper to be printed is soiled by a lesser amount in a normal image forming operation, which will be performed after the current detecting operation of the removal of the seal 102 is completed.

In a step S16, the control module 103 activates a raster-scanning device to form an electrostatic latent image on the charged photoconductive drum 110. The shape of the image may be a rectangular patch, for example. The electrostatic latent patch image is then generally developed into a toner patch image by the developing device 112. However, if the seal 102 has not been removed from the installed developing device. 112, the latent patch image is not developed, i.e., no toner patch image is formed.

In a step S17, the control module 103 receives an output voltage from the toner density sensor 101 that is obtained by reflection of light from the toner patch image on the photoconductive drum 110. The voltage regarding the reflection of light from the toner patch image on the photoconductive drum 110 is referred as "Vsp". The value Vsp can be 2 to 3 volts, for example. However, when the seal 102 has not been removed, the output Vsp is substantially the same as Vsg, i.e., about 4 volts because of no toner patch image is formed. In a step S18, the control module 103 compares a difference "Vsg-Vsp" and a threshold value "th1", The threshold value th1 is set, for example, to 0.5 volts. When the seal 102 has been removed, the difference Vsg-Vsp becomes 1 to 2 volts, for example, which is larger than the threshold value th1. However, when the seal 102 has not been removed, the difference Vsg-Vsp becomes close to zero volts, for example, which is smaller than the threshold value th1. Thus, the control module 103 can determine whether the seal 102 is removed. When the difference Vsg-Vsp is larger than the threshold value th1, the process proceeds to a step S19, otherwise branches to a step S21.

The threshold value th1 may be determined in advance based on experiments, for example, a half of the difference Vsg-Vsp of the case when the seal 102 is removed, such as 0.5 volts as the above example. In the beginning of a developing device 112 in use, the toner in the device 112 may not be sufficiently charged; hence, an optical density of a toner patch may be relatively thin. Accordingly, a value Vsp obtained by an insufficiently charged toner may be a relatively high voltage in comparison with a value Vsp obtained by a sufficiently charged toner. Further, the surface of the photoconductive drum 110 is sometimes soiled by the insufficiently charged toner and Vsg becomes a smaller value, such as 3.5 volts. In view of that, the threshold value th1 may be set to a relatively smaller value, such as 0.3 volts.

In the stop S19, the control module 103 sends a command to the motor drive 104 to continue the rotation of the first motor 108 and stop the second motor 109. Thus, the agitation of the developer mix in the developing device 112 is continued and the photoconductive dram 110 is halted. The agitation of the developer mix in the developing device 112 is effective to impart electrical charge to the toner in a sufficiently large quantity to form a quality image, especially for the developer mix that has not been in use for a relatively long time.

In a step S20, the control module 103 adjusts an optical density for preparing images for a normal image forming operation, which would be performed after the seal removal detecting operation. For adjusting the optical density of image, the control module 103 forms a second toner patch image on the photoconductive drum 110. The optical density of the second toner path image may be denser than the toner patch image formed in the step S16 because the developer mix is agitated in the step S19. Thereby, the adjustment operation of the optical density of the image is performed more accurately. In addition, the control module 103 can adjust the intensity of the emitting device of the toner density sensor 101 preceding the adjustment of the optical density of image for calibrating the toner density sensor 101.

In the step S21, the control module 103 stops the power supply 105 from outputting power. That is, the power supply 105 stops supplying the power for charging the photoconductive drum 110, the bias voltage to the developing device 112, and the counter-transfer voltage to the image transfer device 113. In the step S22, the control module 103 sends a command to the motor drive 104 to stop the first motor 108 and the second motor 109, and the motor drive 104 stops the motors 108 and 109. The halt of the photoconductive drum 110 decreases the doctor blade 117 and the photoconductive drum 110 from being damaged because of a lack of toner as a lubricant on the photoconductive drum 110. A rotation time without toner is preferably set to within 20 seconds to decrease the photoconductive drum 110 and the doctor blade 117 from becoming damaged. Therefore, an execution time between the stop S13, which starts rotation of the photoconductive drum 110 and the step S19, which halts the photoconductive drum 110, is preferably set to less around 20 seconds.

In a step S23, the control module 103 sends a command to the operation panel 107 to display messages "REMOVE THE SEAL" and "CLOSE THE DOOR", and the operation panel 107 displays the message, According to the messages, the user of the image-forming apparatus 100 may remove the seal 102 and close the door, which encloses the developing device 112.

In a step S24, the control module 103 receives information on the door from the door interlock sensor 160 via the input device 1031, and then determines whether the door is closed. When the door is closed, the procedure returns to the step S13. When the door is not closed, the procedure returns to the step S23 to wait for the door to be closed.

Figure 5:
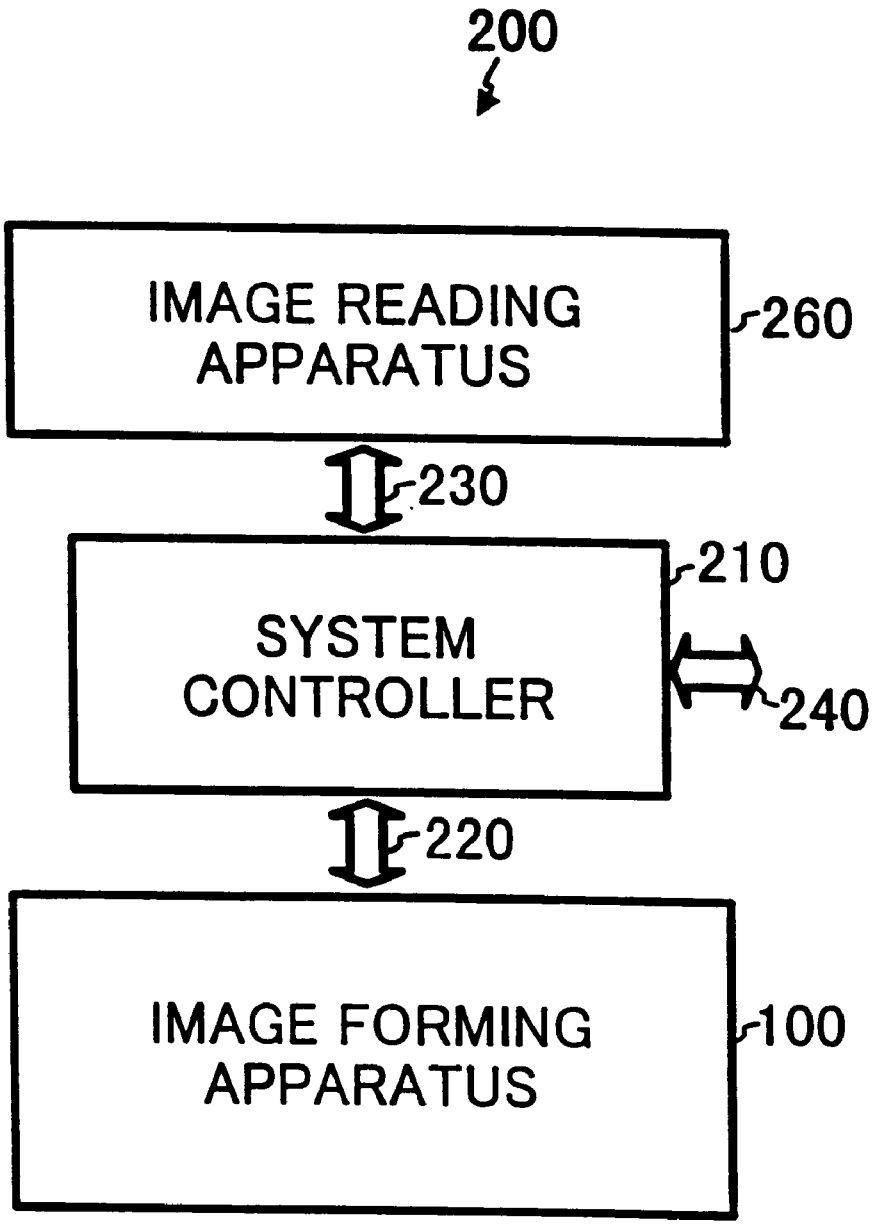
FIG. 5 is a block diagram of an image-processing apparatus as another exemplary embodiment according to the present invention.

FIG. 5 is a block diagram illustrating an image-processing apparatus 200 as another exemplary embodiment of the present invention. The image-processing apparatus 200 functions as a network printer, a photocopier and a facsimile machine. The image-processing apparatus 200 has an image-forming apparatus 100, which is substantially the same as the image-forming apparatus 100 of FIG. 1, a system controller 210, and an image-reading device 260. The system controller 210 and the image-forming apparatus 100 are connected by a first system bus 220. The system controller 210 and the image-reading device 260 are also connected by a second system bus 230. The system controller 210 has a communication terminal 240, which connects to an external communication line.

The image-reading device 260 reads a document and generates image data. The image-forming apparatus 100 forms a toner image on a sheet of paper according to image data. The system controller 210 receives print data and facsimile data, transmits facsimile data, and controls the image-forming apparatus 100 and the image-reading device 260. When the image-processing apparatus 200 functions as a network printer, the system controller 210 receives print data via the communication terminal 240, and sends the print data to the image-forming apparatus 100 to form a toner image on a sheet of paper. The image-forming apparatus 100 forms a toner image on a sheet of paper according to the received print data.

When the image-processing apparatus 200 functions as a photocopier, the system controller 210 sends a command to the image-reading device 260 via the second system bus 230 to read a document. The system controller 210 also sends a command to the image-forming apparatus 100 to form a toner image in a sheet of paper via the first system bus 220. According to the commands, the image-reading device 260 reads the document and sends read image data to the image-forming apparatus 100 via the first and second system buses 220 and 230, and the image-forming apparatus 100 forms a toner image on a sheet of paper according to the read image data.

When the image-processing apparatus 200 functions as a facsimile transmission machine, the system controller 210 sends a command to the image-reading device 260 via the second system bus 230 to read a document, and sends out the read data to an external receiving machine via the communication terminal 240. When the image-processing apparatus 200 functions as a facsimile-receiving machine, the system controller 210 first receives facsimile data from an external facsimile machine via the communication terminal 240. The system controller 210 then sends a command accompanied with the received facsimile data via the first system bus 220 to the image-forming apparatus 100 to form a toner image in a sheet of paper. The image-forming apparatus 100 forms a toner image on a sheet of paper according to the received facsimile data.

As described above, the image-forming apparatus according to the present invention has a replaceable compact developing device with a seal for a developer and a method for detecting a removal the seal.

Further, the image-forming apparatus according to the present invention has a replaceable compact developing device with a seal for a developer and a method for detecting a removal of the seal so as to prevent a doctor blade for an image bearer and the image bearer from becoming damaged.

The processes set forth in the present description may be implemented using a conventional general purpose microprocessor programmed according to the teachings of the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a computer to perform a process in accordance with the present invention. The storage medium can include, but is not limited to, any type of disk including floppy disk, optical disk, CD-ROMS, and magneto-optical disks, ROMS, RAMS, EPROMS, BEPROMS, flash memory, magnetic or optical cards, Or any type of media suitable for storing electronic instructions.

Obviously, numerous modifications and variations of the present invention are possible in light of the above teachings. For example, features described for certain embodiments may be combined with other embodiments described herein. It is therefore to be understood that within the scope of the appended claims, the invention may be practiced otherwise than as specifically described herein.

This document is based on Japanese patent application No. 11-007900 filed in the Japanese Patent Office on Jan. 14, 1999, the entire contents of which are incorporated herein by reference.

What is claimed as new and is desired to be secured by Letters Patents of the united states:

1. An image-forming apparatus comprising:

an image-bearing device configured to hold thereon an electrostatic latent image and a toner image;

a density sensor configured to detect an optical density of a surface of the image-bearing device and a toner image on the image-bearing device;

a developer container configured to hold a developer therein and agitate the developer, said developer having at least a toner, said developer container having, a developer-bearing device configured to carry the developer thereon and develop the electrostatic latent image on the image-bearing device, and a developer seal configured to seal the developer in the developer container, wherein the seal is disposed between the developer container and the developer-bearing device;

an actuator configured to actuate the developer-bearing device in the developer container; and a control device configured to determine whether the developer seal is removed according to information regarding the optical density of the toner image output by the density sensor.

2. An image-forming apparatus according to claim 1, wherein:

the density sensor is configured to detect an optical density of the surface of the image-bearing device without the toner image thereon and with the toner image on the surface of the image-bearing device; and the control device being configured to determine when the developer seal is removed by comparing the optical density of the surface of the image-bearing device and the optical density of the toner image.

3. An image-forming apparatus according to claim 1, wherein:

the control device is configured to whether the developer seal is removed within 20 seconds after the actuator starts actuating the developer-bearing device in the developing device.

4. An image-forming apparatus according to claim 1 further comprising:

an image transfer device and said image transferring device being configured to have opposite electrical polarities when transferring a toner image from the image-bearing device to an image-bearing sheet but a same electrical polarity when determining whether the developer seal is removed.

5. An image-forming apparatus according to claim 1, further comprising:

an image transfer device configured to transfer a toner image from the image-bearing device to in image-bearing sheet; and a cleaning device configured to clean the image transfer device after the control device determines the developer seal has been removed.

6. An image-forming apparatus according to claim 1, further comprising:

an instruction mechanism configured to display a message instructing a removal operation of the developer seal when the control device determines that the removal of the developer seal has not been removed.

7. An image forming apparatus according to claim 1, wherein:

the control device is configured to control a toner density of an image formed in a normal image forming operation according to information from an optical density measured on a second toner image on the image-bearing device.

8. An image-forming apparatus according to claim 7, wherein:

the optical density of the second toner image is used to control the toner concentration of the developer and is set to be denser than the optical density of the toner image for detecting a removal of the developer seal.

9. An image-forming apparatus according to claim 7, wherein:

the second toner image is formed after a predetermined time from when an actuation of the developer container and the developing device following a determination that the developer seal was removed.

10. An image-forming apparatus accords, to claim 1, wherein:

the developer also includes a carrier component.

11. An image-forming apparatus according to claim 1, wherein:

the developer container, the developing device and the developer seal are integrated into a single module.

12. An image-forming apparatus according to claim 11, wherein:

the single module is configured to be removably installed in the apparatus.

13. An image-forming apparatus according to claim 1, further comprising:

at least one of an image printer engine, a photocopier engine and a facsimile engine.

14. An image-forming apparatus comprising:

means for holding an electrostatic latent image and a toner image;

means for detecting an optical density of a surface of the means for holding when the toner image is not present and when the toner image is present;

means for containing and agitating a developer having at least a toner, including means for bearing the developer and developing the electrostatic latent image on the means for holding, and means for sealing the developer in the means for containing and agitating, wherein the means for sealing is disposed between the means for containing and agitating and the means for bearing the developer and developing;

means for actuating the means for bearing the developer and developing; and means for determining whether the means for sealing is removed according to information on the optical density of the toner image output by the means for detecting an optical density.

15. An image-forming apparatus according to claim 14, wherein:

the means for determining determines if the means for sealing is present by comparing the optical density of the surface of the image-bearing means and the optical density of the toner image.

16. An image-forming apparatus according to claim 14, wherein:

the means for determining determines whether the means for sealing is present within 20 seconds after the means for actuating starts actuating the means for containing and agitating.

17. An image-forming apparatus according to claim 14, further comprising:

means for transferring the toner image from the means for holding to an image-bearing sheet wherein, an electrical polarity of the means for transferring is opposite to an electrical polarity of said toner image when transferring said toner image to said image-bearing sheet but a same polarity as said toner image when said means for determining is determining whether said means for sealing is removed.

18. An image-forming apparatus according to claim 14, further comprising:

means for transferring the toner image from the image-bearing to an image-bearing sheet; and means for cleaning the means for transferring after the means for determining determines that the means for sealing has been removed.

19. An image-forming apparatus according to claim 14, further comprising:

means for displaying a message that provides an instruction on how to remove the means for sealing when the means for determining determines that the means for sealing has not been removed.

20. An image-forming apparatus according to claim 14, wherein:

the means for determining includes means for controlling the toner density of an image formed in a normal image forming operation according to information from an optical density measured on a second toner image on the means for holding.

21. An image-forming apparatus according to claim 20, wherein:

the optical density of the second toner image for controlling the toner concentration of the developer is set to be denser than the optical density of the toner image when detecting that the means for sealing was removed.

22. An image-forming apparatus according to claim 20, wherein:

the second toner image is formed a predetermined time after an actuation of the means for containing means and agitating after a determination that the means for sealing was removed.

23. An image-forming apparatus according to claim 14, wherein:

the developer also includes a carrier component.

24. An image-forming apparatus according to claim 14, wherein:

the means for containing, the means for bearing the developer and the means for sealing are integrated into a single module.

25. An image-forming apparatus according to claim 24, wherein:

the single module is configured to be removably installed in the apparatus.

26. An image-forming apparatus according to claim 14, further comprising:

at least one of an image printer engine, a photocopier engine and a facsimile engine.

27. A method for detecting whether a developer container is unsealed, comprising steps of:

agitating a developer having a toner;

forming an electrostatic latent image;

transferring the developer to a body;

developing the electrostatic latent image with the developer to create a toner image;

detecting an optical density of the toner image that results from the developing step;

receiving information on the optical density of the developed toner image; and determining whether the developer is unsealed based on the information.

28. A method for detecting whether a developer container is unsealed according to claim 27, wherein:

the detecting step includes at least one of detecting an optical density of a surface of an image-bearing device, and detecting an optical density of the toner image when the toner image is present on the image-bearing device, and the determining step includes determining whether the developer container is unsealed by comparing the information received in said receiving step with a predetermined threshold.

29. A method for detecting whether a developer container is unsealed according to claim 27, wherein:

the determining step includes determining whether the developer container is unsealed within 20 seconds after starting the forming step.

30. A method for detecting whether a developer container is unsealed according to claim 27, further comprising a step of:

providing to a toner transferring device a same electrical polarity as applied to a toner of the toner image determining if said developer container is sealed.

31. A method for detecting whether a developer container is unsealed according to claim 27, further comprising a stop of:

cleaning a toner image transferring device after the determining step.

32. A method for detecting whether a developer container is unsealed according to claim 27, further comprising a step of:

displaying a message that provides an instruction regarding how to unseal the developer when the determining step determines that the developer is unsealed.

33. A method for detecting whether a developer container is unsealed according to claim 27, further comprising a step of:

controlling a density of a subsequent toner image following the determining step when it is determined in the determining step that the develop or is unsealed.

34. A method for detecting whether a developer container is unsealed according to claim 33, wherein:

the controlling step includes creating the subsequent toner image to be denser than the toner image used to determine that the developer is unsealed.

35. A method for detecting an unsealed developer according to clam 33, wherein:

the controlling step is executed after a predetermined time of agitation of the developer following a determination that the developer container is unsealed.

36. A computer readable medium having instructions encoded therein that when executed by a processor detect an unsealing of a developer container by performing the steps of:

agitating a developer having a toner;

forming an electrostatic latent image;

transferring the developer to a body;

developing the electrostatic latent image with the developer to create a toner image;

detecting an optical density of the toner image that results from the developing step;

receiving information on the optical density of the developed toner image; and determining whether the developer is unsealed based on the information.

37. A computer readable medium according to claim 36, wherein:

the detecting step includes at least one of detecting an optical density of a surface of an image-bearing device, and detecting an optical density of the toner image when the toner image is present on the image-bearing device; and the determining step includes determining whether the developer container is unsealed by comparing the information received in said receiving step with a predetermined threshold.

38. A computer readable medium according to claim 36, wherein:

the determining step includes determining whether the developer container is unsealed within 20 seconds after starting the forming step.

39. A computer readable medium according to claim 36, further comprising a step of:

providing to a toner transferring device a same electrical polarity as applied to a toner of the toner image determining if said developer container is sealed.

40. A computer readable medium according to claim 36, further comprising a step of:

cleaning a toner image transferring, device after the determining step.

41. A computer readable medium according to claim 36, further comprising a step of:

displaying message that provides an instruction regarding bow to unseal the developer container when the determining step determines that the developer container is unsealed.

42. A computer readable medium according to claim 36, further comprising a step of:

controlling a density of a subsequent toner image following the determining step when it is determined in the determining step that the developer is unsealed.

43. A computer readable medium according to claim 42, wherein:

the controlling step includes creating the subsequent toner image to be denser than the toner image used to determine that the developer is unsealed.

44. A computer readable medium according to claim 42, , wherein:

the controlling step is executed after a predetermined time of agitation of the developer following a determination that the developer container is unsealed.

* * * * *